US007543566B2

(12) United States Patent
Holl et al.

(10) Patent No.: US 7,543,566 B2
(45) Date of Patent: Jun. 9, 2009

(54) METHOD AND CONTROL UNIT FOR OPERATING AN INTERNAL COMBUSTION ENGINE HAVING AN INJECTION SYSTEM

(75) Inventors: Andreas Holl, Korntal-Muenchingen (DE); Ruslan Sova, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/586,227

(22) PCT Filed: Dec. 8, 2004

(86) PCT No.: PCT/EP2004/053347

§ 371 (c)(1),
(2), (4) Date: Jun. 26, 2007

(87) PCT Pub. No.: WO2005/068810

PCT Pub. Date: Jul. 28, 2005

(65) Prior Publication Data

US 2007/0272208 A1 Nov. 29, 2007

(30) Foreign Application Priority Data

Jan. 14, 2004 (DE) ..... 10 2004 001 877
Feb. 11, 2004 (DE) ..... 10 2004 006 694

(51) Int. Cl.
*F02M 57/02* (2006.01)

(52) U.S. Cl. ..... 123/446; 123/447; 123/494

(58) Field of Classification Search ..... 123/446, 123/457, 458, 494
See application file for complete search history.

(56) References Cited

U.S. PATENT DOCUMENTS 4,381,750 A * 5/1983 Funada ..... 123/446
4,633,837 A * 1/1987 Babitzka et al. ..... 123/478
5,507,266 A 4/1996 Wright et al.
5,678,521 A * 10/1997 Thompson et al. ..... 123/447
5,722,373 A * 3/1998 Paul et al. ..... 123/446

(Continued)

FOREIGN PATENT DOCUMENTS

DE 197 57 594 7/1999

(Continued)

OTHER PUBLICATIONS

International Search Report, PCT International Patent Application No. PCT/EP2004/053347, Mar. 30, 2005.

(Continued)

*Primary Examiner*—Thomas N Moulis
(74) *Attorney, Agent, or Firm*—Kenyon & Kenyon LLP

(57) ABSTRACT

In a method, a computer program and a control unit for operating an internal combustion engine having an injection system, e.g., for a motor vehicle, in the injection system fuel is conveyed into a fuel accumulator by a metering unit and a high-pressure pump. The pressure in the fuel accumulator is recorded and controlled by control of the metering unit with the aid of the control unit. In order to consider also possible manufacturing tolerances of individual metering units in the control of the pressure in the fuel accumulator of such a system, which is already known as such, and thereby make the control more precise, an individual characteristic curve is provided for the actually used metering unit be ascertained and taken into account in the pressure regulation.

19 Claims, 4 Drawing Sheets

U.S. PATENT DOCUMENTS

| | | | | |
|---|---|---|---|---|
| 6,792,919 | B2 * | 9/2004 | Kohketsu et al. | 123/447 |
| 2003/0037769 | A1 * | 2/2003 | Frenz et al. | 123/446 |
| 2004/0250794 | A1 * | 12/2004 | Wolber et al. | 123/446 |

FOREIGN PATENT DOCUMENTS

| | | |
|---|---|---|
| DE | 10044514 | 3/2001 |
| DE | 101 31 507 | 1/2003 |
| EP | 0 677 655 | 10/1995 |
| EP | 1 298 306 | 4/2003 |
| GB | 2 378 773 | 2/2003 |
| JP | 2001152922 | 6/2001 |
| JP | 2003056396 | 2/2003 |
| JP | 2003097327 | 4/2003 |
| JP | 2004233322 | 8/2004 |

OTHER PUBLICATIONS

Written Opinion of the International Searching Authority, PCT International Patent Application No. PCT/EP2004/053347, Mar. 30, 2005 (translation of supplemental pages provided).

* cited by examiner

METHOD AND CONTROL UNIT FOR OPERATING AN INTERNAL COMBUSTION ENGINE HAVING AN INJECTION SYSTEM

FIELD OF THE INVENTION

The present invention relates to a method, a computer program and a control unit for operating an internal combustion engine having an injection system, e.g., for a motor vehicle. Furthermore, the present invention relates to a data carrier having this computer program, and an internal combustion engine having this control unit.

BACKGROUND INFORMATION

Such a method and control unit are described, for example, in German Publication Patent Application No. 101 31 507, which describes an injection system for an internal combustion engine in which fuel is conveyed into a fuel accumulator by a metering unit and a high-pressure pump. The injection system also includes two closed-loop control circuits to regulate the pressure in the fuel accumulator. A first closed-loop control circuit regulates this pressure by suitable control of a pressure-control valve on the high-pressure side of the injection system. A second closed-loop control circuit regulates the pressure in the fuel accumulator by suitable triggering of the metering unit on the low-pressure side of the injection system. To keep inaccuracies in the high-pressure control of the pressure in the fuel accumulator as low as possible—such inaccuracies being attributable to manufacturing tolerances in the serial production of the pressure-control valve—a method is described for generating an individual characteristic curve that represents the actual response of a particular pressure-control valve. Rather than using an approximated or standardized characteristic curve, the pressure-control valve is then controlled according to this individual characteristic curve within the framework of the first closed-loop control circuit.

Inaccuracies may occur in the control of the pressure in the fuel accumulator via the second closed-loop control circuit as well. This is true especially when, for instance, the response of an actually used metering unit deviates from an expected response of a standardized metering unit because of manufacturing tolerances.

SUMMARY

Example embodiments of the present invention may provide a method, a computer program as well as a control unit for operating an internal combustion engine having an injection system which may allow the particular response of individual metering units during their operation to be taken into account.

This method includes the ascertainment of an individual characteristic curve representing the actual response of the metering unit for the control of the metering unit during operation of the internal combustion engine.

The individual characteristic curve generated reflects the real response of an actually used metering unit much more precisely than a standard characteristic curve, which typically represents the statistically averaged response of a large number of manufactured metering units each having different manufacturing tolerances. If the individual characteristic curve ascertained on the basis of the method hereof is utilized for the actually used metering unit in the control of the pressure in the fuel accumulator, this control is much more precise than the control that would result on the basis of a standard characteristic curve.

The characteristic curve normally represents the fuel quantity, or the mass flow, provided by the metering unit to the high-pressure pump as a function of the magnitude of its electrical control current.

The method generates the individual characteristic curve by interpolation of at least two ascertained interpolation points for this characteristic curve. To determine such an interpolation point, the method includes the following steps:

Operation of the internal combustion engine in a suitable predetermined reference operating point; and ascertainment of the provisional interpolation point of the individual characteristic curve for the reference operating point in the form of a value pair that encompasses the fuel mass flow provided by the metering unit for the high-pressure pump in the reference operating point and the associated electrical control current.

This determination of the individual interpolation points may be implemented only after the internal combustion engine has reached a predefined minimum temperature during operation in the reference point. It is only then that the reference operating point is stable. The support values ascertained in a stable reference operating point represent the real response of an actually used metering unit more precisely than support points that were ascertained in an unstable or still fluctuating reference operating point.

The precision with which the ascertained support points reflect the real response of a metering unit may be improved further in that, to begin with, they are specified only provisionally by the described method. It is then advisable to ascertain a multitude of provisional support points for one and the same predefined reference operating point by repeating the indicated method steps multiple times, so as to then determine, via suitable filtering of this multitude of support points, a final support point that represents the real response of the metering unit even more precisely.

The support points used for the interpolation of the individual characteristic curve to be determined may be ascertained for different operating states of the internal combustion engine, for instance for idle operation or full-load operation. Furthermore, it is advisable to generate the support points for the particular operating states in which the internal combustion engine is operated most often.

A difference between the standard characteristic curve and the ascertained individual characteristic curve is calculated. The pressure as control variable is corrected with the aid of a correction characteristic curve representing this difference. The adjusted control variable is able to be monitored much more precisely, i.e., by more narrowly predefined mass-flow limit values, than the uncorrected control variable. The reason for this is that the pressure threshold values for the corrected control variable need not consider possible fluctuations of the control variable as a result of the response of the actually used metering unit which may deviate from a standard response.

A difference between the standard characteristic curve and the ascertained individual characteristic curve is calculated. The mass flow as actuating variable (fuel quantity supplied by the metering unit) is adjusted with the aid of a correction characteristics curve representing this difference. The adjusted actuating variable may be able to be monitored much more precisely, i.e., by more narrowly predefined mass-flow limit values, than the uncorrected control variable. The reason for this is that the mass-flow limit values for the corrected control variable need not consider the deviation as a result of a response of the actually used metering device which may deviate from a standard response.

A computer program and a control unit are described for implementing this method, a data carrier may include the computer program, and an internal combustion engine may include the control unit.

DETAILED DESCRIPTION

Hereinafter, example embodiments of the present invention are described in greater detail with reference to the appended Figures.

Figure 1:
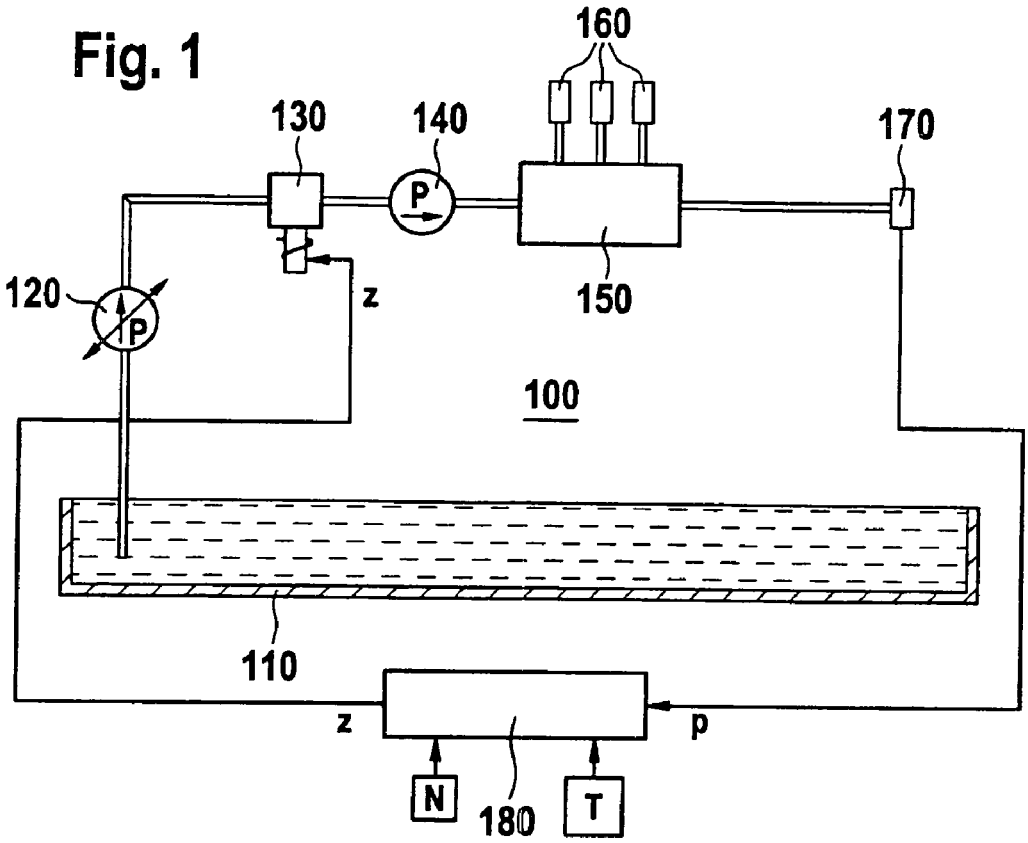
FIG. 1 illustrates the structure of an injection system for an internal combustion engine.

FIG. 1 illustrates an injection system 100 for an internal combustion engine. It includes a fuel tank 110 from which fuel is conveyed to a metering unit 130 with the aid of an electrical fuel pump 120. In response to a control signal z, metering unit 130 provides a specific fuel quantity for a downstream high-pressure pump 140. The high-pressure pump pumps the fuel into a fuel accumulator 150. The fuel is stored in fuel accumulator 150 under high pressure in order to be available to fuel injectors 160 of the internal combustion engine upon request. The magnitude of the pressure in the fuel accumulator is measured with the aid of a pressure sensor 170. Pressure sensor 170 conveys the measured pressure in fuel accumulator 150 in the form of a measuring signal p to a control unit 180 of injection system 100. Control unit 180 substantially functions as pressure controller to control the pressure in fuel accumulator 150 in response to measuring signal p, taking into account, among others, instantaneous rotational speed N and instantaneous operating temperature T of the internal combustion engine.

Hereinafter, the method for generating individual characteristic curve iKL or the corrected characteristic curve will be described in greater detail.

Figure 2:
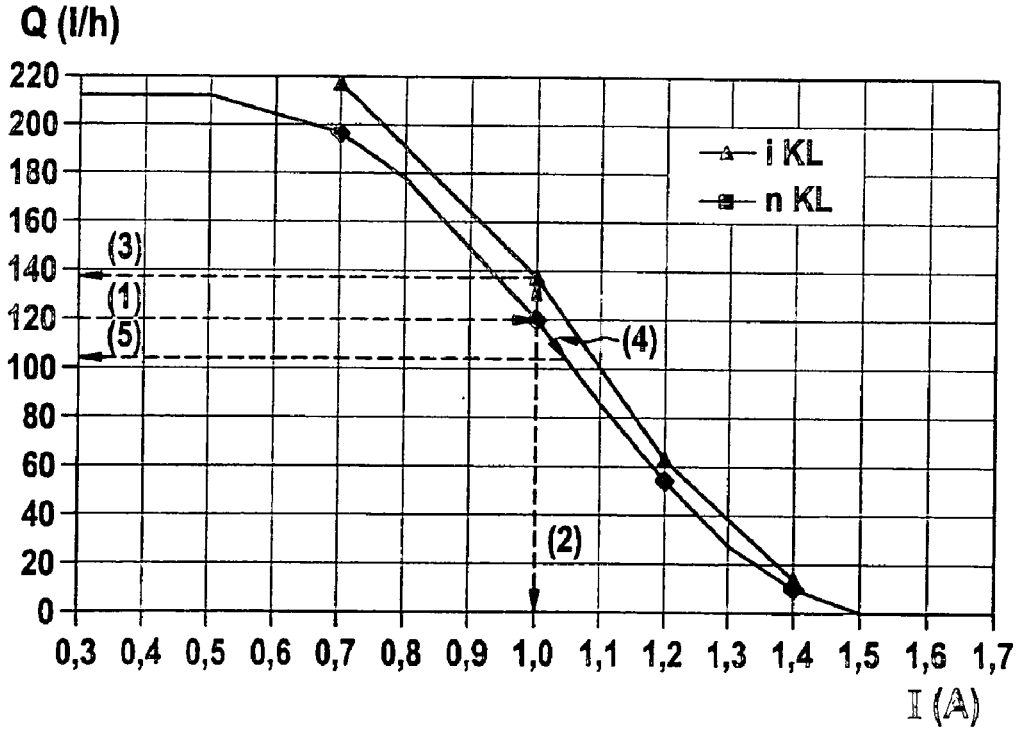
FIG. 2 illustrates a faulty control of a metering unit.

To this end, FIG. 2 first of all illustrates a fault that occurs when the actually used metering unit 130 is controlled on the basis of an incorrect characteristic curve. In FIG. 2, a force current-mass flow Q of the metering unit, measured in liters per hour, for instance, is plotted over its electrical control current I. In other words, FIG. 2 illustrates the particular control current I for a metering unit that induces the metering unit to provide a desired quantity or a desired mass flow of fuel for high-pressure pump 140. However, to a crucial extent, this quantity depends on the response of actually used metering unit 130, as illustrated in FIG. 2 and elucidated in the following.

Figure 4:
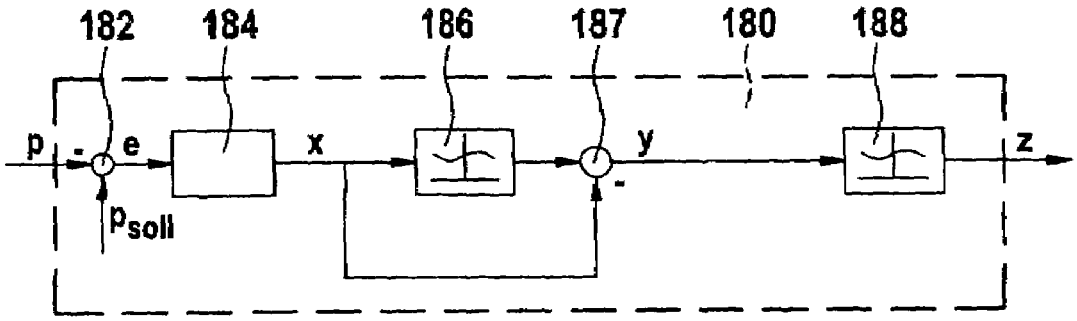
FIG. 4 illustrates the structure of a control unit according to an example embodiment of the present invention.

FIG. 2 illustrates two characteristic curves, the first representing a standard characteristic curve nKL, and the second representing an individual characteristic curve iKL. Standard characteristic curve nKL normally represents the statistically averaged response of a multitude of metering units having different manufacturing tolerances. In contrast, individual characteristic curve iKL represents the real response of actually used metering unit 130. Since the individual characteristic curve illustrated in FIG. 2 lies above the standard characteristic curve it can be gathered that actually used metering unit 130 provides a larger fuel quantity than a standardized metering unit given the same control current I. This is illustrated in FIG. 2 by the following example:

If, due to an instantaneous pressure-control deviation e, pressure-control unit 184 (cf. FIG. 4) determines a mass-flow requirement of 120 liters (1) to be provided by metering unit 130, it would be necessary to trigger it by a control current of 1 A (2) based on standard characteristic curve nKL, i.e., a standardized response of metering unit 130.

However, since in the example illustrated in FIG. 2 the metering unit actually used deviates from the standard in its response, actually used metering unit 130 in reality would not provide the requested 120 liters per hour for high-pressure pump 140 (3) when triggered by a current of 1 A, but rather a mass flow of approximately 138 liters of fuel per hour. This control of the metering unit, faulty from the perspective of the pressure control, would lead to an undesired pressure increase in the fuel accumulator, which would be detected by pressure sensor 170 and conveyed to control unit 180 as new instantaneous pressure via measuring signal p. The pressure control in control unit 180 would then attempt to compensate (4) this undesired excess pressure in the form of a fault compensation via an integration component in pressure-control unit 184, which ultimately would lead to another faulty fuel quantity (5) supplied by the metering unit if it were based exclusively on the incorrect standard characteristic curve nKL. In this case, the mass flow adjusted by pressure-control unit 184 in metering unit 130 in this manner would lie even below the originally requested 120 liters per hour since the control unit had to assume that the originally adjusted value (3) was too high.

Figure 3:
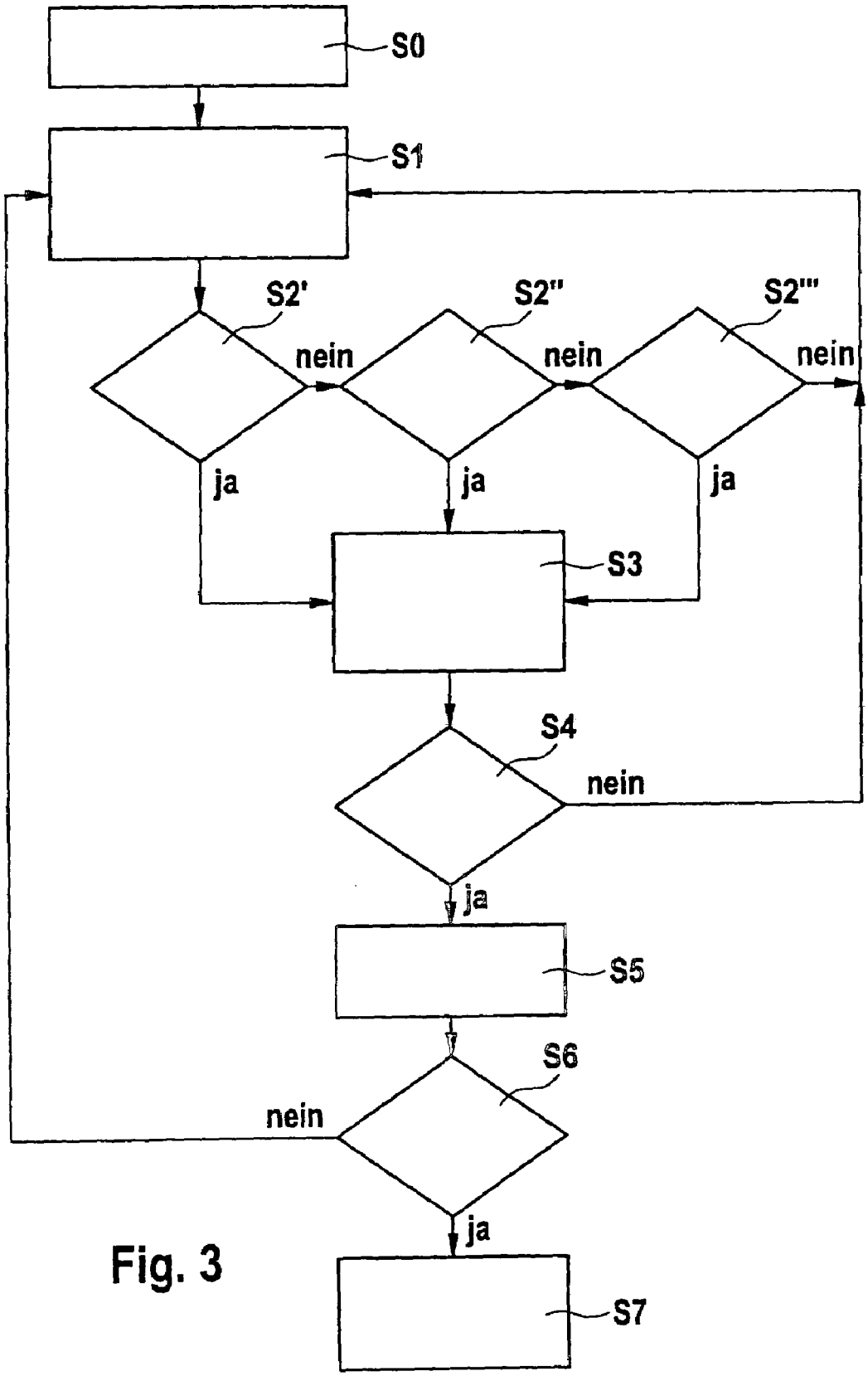
FIG. 3 illustrates a method according to an example embodiment of the present invention.

In order to avoid such instabilities in the control of the pressure in a fuel accumulator 150 via a volume-flow control with the aid of metering unit 130 on the low-pressure side, a method is provided for generating the individual characteristic curve. The determination of the individual characteristic curve according to FIG. 3 relates to a control unit which initially does not include a correction characteristic curve or filter device, but in which the output of the pressure-control unit is used for the direct control of metering unit 130, such an individual characteristic curve representing the actual response of metering unit 130 much more precisely than the standard characteristic curve; cf. FIG. 2.

To begin with, this requires the internal combustion engine having the injection system to be taken into operation and then to wait until the operating temperature of the internal combustion engine has risen beyond a predefined minimum temperature T. Only then will a so-called learning function be started according to method step S0. The learning function denotes a type of operating mode of control unit 180 that allows the generation of individual characteristic curve iKL, preferably parallel to normal operation of the internal combustion engine. Within the framework of this learning function the instantaneous operating state of the internal combustion engine is then checked, e.g., continuously, according to a method step S1, so as to determine whether, or when, one of usually several predefined reference operating points is assumed by the internal combustion engine. Each of these reference operating points is typically defined by a predefined pressure in the fuel accumulator, a predefined injection quantity into the combustion chambers of the internal combustion engine and/or by a predefined rotational speed N of the internal combustion engine. The reference operating points may be distributed among different operating states of the internal combustion engine. These operating states may be states that the internal combustion engine assumes especially often due to its particular use or its specific utilization spectrum.

If it is determined in method step S2' that the internal combustion engine is currently operated in a first predefined reference point, the instantaneous value of control signal x is detected at the output of pressure-control unit 184 (cf. FIG. 4) and buffer-stored. In addition, an associated fuel-mass flow is ascertained. This takes place in method step S3. An analogous procedure is used if it is determined in method step S2' that the internal combustion engine is currently not operated in the first reference operating point, but in a second or third reference operating point, which is ascertained in method steps S2" and S2'''.

Control signal x is sampled not only once but, e.g., multiple times in a detected reference operating point, so that in method step S3 not only a single value but a multitude of values for control signal x is available for an individual reference operating point.

In method step 4, the sampled values for control signal x are then filtered, i.e., they are monitored or analyzed to determine to what extent they represent a stabilized value for control signal x in the instantaneously assumed reference operating point. This evaluation may be carried out such, for example, that it is checked whether the sampled values are within a predefined $\epsilon$ region about a limit value. If such an evaluation reveals that the sampled values of the control signal still fluctuate too much and no stabilized value can be found, it is branched back from method step S4 to method step S1 and method steps S2, S3 and S4 are then repeated. As an alternative to a limit value consideration, the sampled values may also be subjected to a stabilization during filtering in step S4, by mean value generation.

If it has been determined at the end of method step S2''' that the internal combustion engine is currently not operated in any of the reference operating points, the method branches back to method step S1 again.

However, if it is detected in method step S4 that the sampled values for control signal x do indeed represent a stable value, this value will be defined as final support point for the particular reference point on the individual characteristic curve for the metering unit actually used in each case, such definition taking place in method step S5. The individual reference point for which a stabilized control signal was defined will then be considered learned within the scope of the learning function.

Method step S6 is then used to check whether all reference points are considered learned already. If this is not the case, the method branches back to method step S1 according to FIG. 3 where, in cooperation with method steps S2', S2" and S2''', it will then be checked once more whether the internal combustion engine is in one of the reference points for which no stabilized control signal z has been defined as yet. The method steps S3, S4, S5 and S6 are then run through once more for these reference operating points. However, if it is determined in method step S6 that all or at least a sufficient number of reference operating points have/has been learned, the individual characteristic curve iKL for metering unit 130 actually used is determined according to method step S7 by interpolation of the final support points. The deflections in the individual characteristic curve occurring in the interpolation may then be smoothed by extrapolation.

The individual characteristic curve for metering unit 130, ascertained according to method step S7, may then be implemented into control unit 180 and used for the precise control of metering unit 130.

As an alternative to this approach, there is also the possibility of deriving a correction characteristic curve from the individual characteristic curve thus determined, the correction characteristic curve representing the differences in the response between the actually used metering unit and a standardized metering unit. This correction characteristic curve is easily determined by forming the difference between the individual and the standard characteristic curve, especially at the support points representing the individual reference operating points.

Having knowledge of this correction characteristic curve, a control signal x for the control of the metering unit, generated as before on the basis of the standard characteristic curve, may then be corrected. To this end, control unit 180 may be implemented as pressure controller according to FIG. 4.

As such, it includes a first subtraction device 182 for generating a pressure control deviation e as the difference between the actual pressure, represented by measuring signal p, and a predefined setpoint pressure $p_{setpoint}$ in fuel accumulator 150. The control unit also includes pressure-control unit 184 to receive control deviation e and to generate a control signal x for metering unit 130 as specified by control deviation e and based on a standard characteristic curve fuel-mass flow/electrical control current. Control signal x represents the fuel delivery quantity required to bring the system deviation to zero, and which is to be supplied by metering unit 130 to high-pressure pump 140 in view of instantaneous pressure-system deviation e.

In addition to the standard characteristic curve, a correction characteristic curve to be generated according to the method is stored in control unit 180 as well. It is used to determine a correction component for control signal x, such correction component representing a control and supply response of the actually used metering unit 130 that may differ from that of a standardized metering unit. With the aid of a second addition and subtraction device 187, control unit 180 then generates a corrected control signal y for metering unit 130. Using the second addition or subtraction device, control signal x is linked with the correction component so as to form corrected control signal y, which represents a corrected quantity request for the fuel supply quantity to be provided by metering unit 130. Control unit 180 also includes a filter device 188 to generate a stabilized corrected control signal z from corrected control signal y for the control of metering unit 130.

The just-described configuration of control unit 180 as pressure controller is based on the assumption that a standard characteristic curve for metering units is stored in the control unit and in pressure-control unit 184, in particular. In addition, correction characteristic curve 186 is stored to adapt the standard characteristic curve to the real response of actually used metering unit 130. The mathematical linking of these two characteristic curves practically generates the new individual characteristic curve, which represents the real response of the actually used metering unit. Calculated corrected control signal y is ultimately based on this individual characteristic curve.

Figure 5:
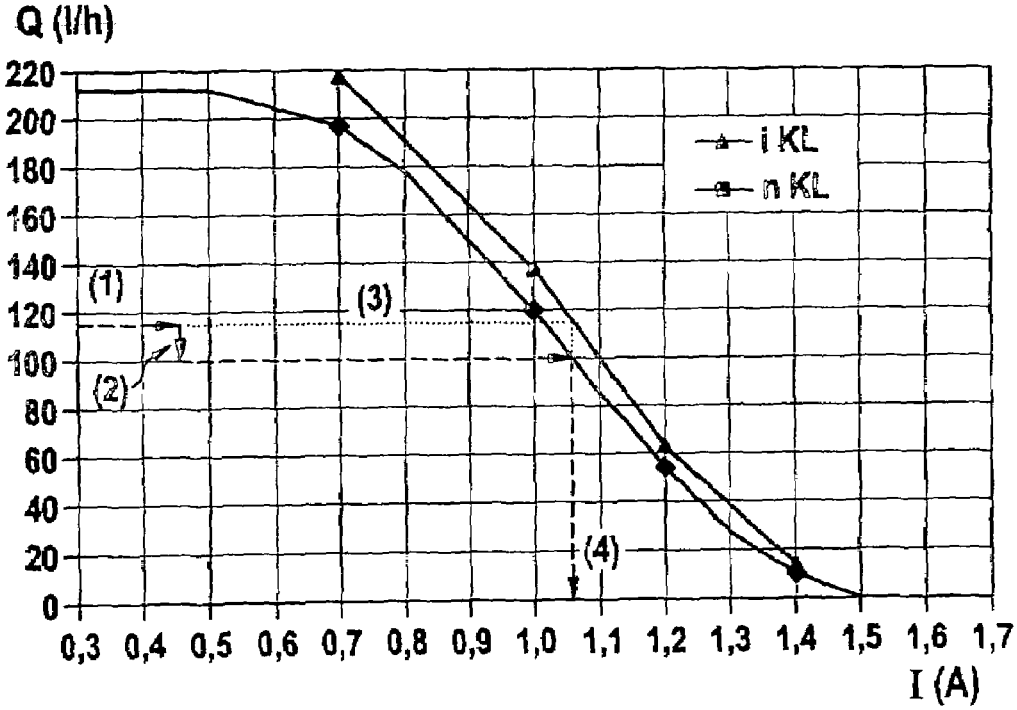
FIG. 5 illustrates an individual characteristic curve for a metering unit, generated according to an example embodiment of the present invention, having corrected control.

FIG. 5 illustrates the effects the use of individual characteristic curve iKL or the use of standard characteristic curve nKL has on the pressure-control response of the injection system, taking the correction characteristic curve into account. As can be seen, once pressure-control unit 184 has determined a specific mass-flow requirement Q to correct an actually detected pressure-control deviation e such as 118 liter per hour (1), this quantity requirement is first modified in accordance with the learned correction characteristic curve (2). Using this corrected quantity requirement, the particular electrical setpoint current required for the control of actually used metering unit 130 to correct detected system deviation is then determined from standard characteristic curve nKL stored in control unit 180. That this current, which has an exemplary value of 1.07 A in FIG. 5, is indeed the correct current can be gathered from FIG. 5 since it results in precisely the required mass flow requirement of 118 liters per hour (3) when individual characteristic curve iKL is used.

Figure 6:
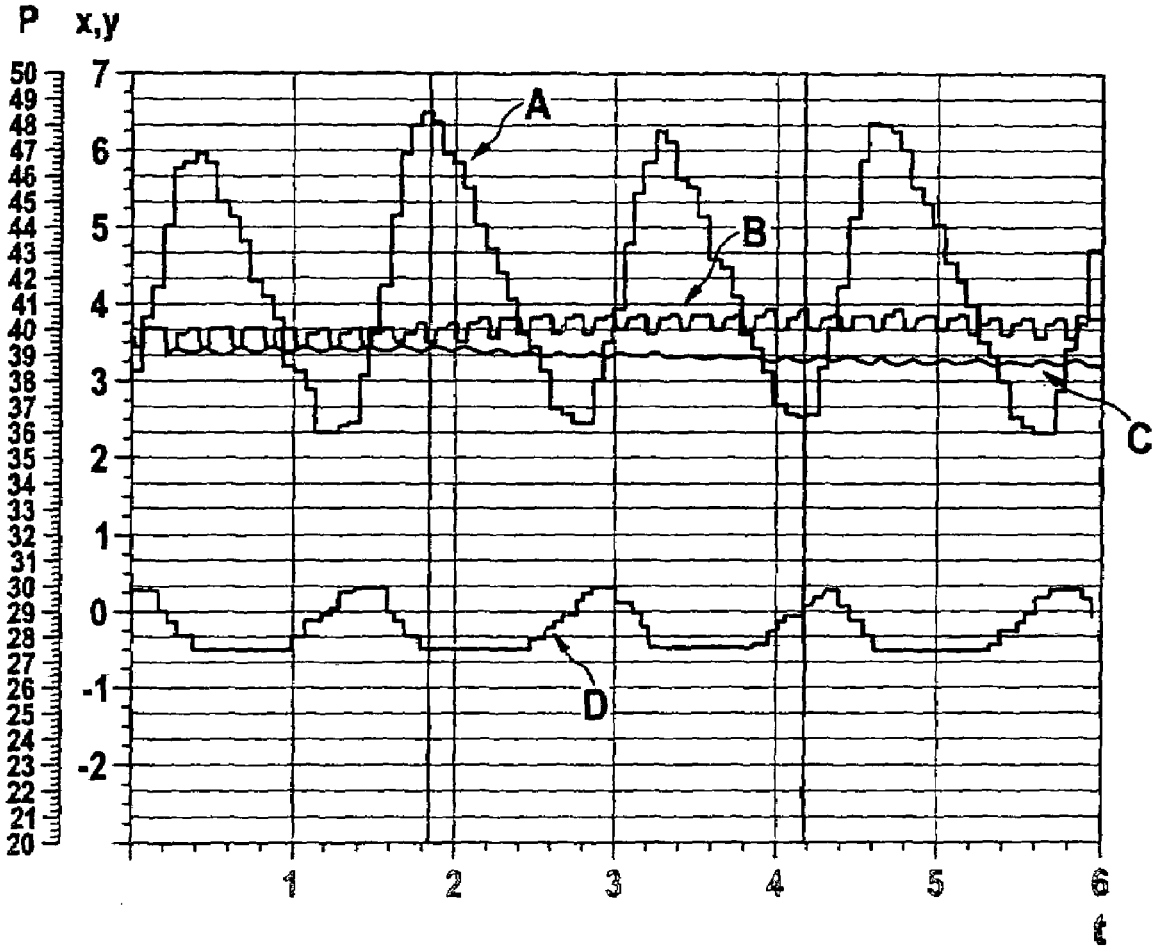
FIG. 6 illustrates the pressure control response of the injection system, e.g., when using the individual characteristic curve for the metering unit.

FIG. 6 illustrates the effects the use of the individual characteristic curve or the use of the standard characteristic curve has on the pressure in fuel accumulator 150, given an additional consideration of the correction characteristic curve. The output of pressure-control unit 184 without correction D, i.e., control signal x, is considerably less stable than the control output with downstream correction C, which represents control signal y, the instability manifesting itself in greater amplitude fluctuations. Correspondingly, without correction A, i.e., when controlling metering unit 130 directly by control signal x, the fluctuations in the pressure in fuel accumulator 150 are considerably greater than pressure fluctuations B in a control of the metering unit by corrected control signal y or even by stabilized control signal z.

The method may be implemented in the form of a computer program. This computer program, possibly together with additional computer programs, may then be stored on a computer-readable data carrier for the control and/or regulation of the injection system of the internal combustion engine. The data carrier may be a diskette, a compact disk, a so-called flash memory, etc. The computer program stored on the data carrier may then be sold to a customer as a product.

As an alternative to a transmission by data carrier, the transmission may also be implemented via an electronic communication network, in particular the Internet.

What is claimed is:

1. A method for operating an internal combustion engine having an injection system, comprising:

conveying fuel into a fuel accumulator by a metering unit and a high-pressure pump;

recording and regulating a pressure in the fuel accumulator by controlling the metering unit;

ascertaining an individual characteristics curve that represents an actual response of the metering unit for control of the metering unit during operation of the internal combustion engine; and determining a support point for the individual characteristic curve which represents a fuel-mass flow supplied by the metering unit for the high pressure pump as a function of a control current, including:

operating the internal combustion engine in a suitable predetermined reference operating point; and ascertaining a provisional support point of the individual characteristic curve for the reference operating point as a value pair encompassing the fuel-mass flow provided by the metering unit in the reference operating point for the high-pressure pump, and an associated electrical control current.

2. The method according to claim 1, wherein the injection system is arranged as an injection system for a motor vehicle.

3. The method according to claim 1, wherein the provisional support point is ascertained only when the internal combustion engine has exceeded a predetermined minimum temperature threshold value during operation in the reference operating point.

4. The method according to claim 1, further comprising:

determining a plurality of provisional support points for one and the same predefined reference operating point by multiple repetition of the operating and ascertaining steps; and determining a final support point for the predefined reference operating point by filtering the multitude of preliminary support points.

5. The method according to claim 4, wherein the filtering includes at least one of (a) mean-value generation and (b) analyzing the determined provisional support points with respect to question whether the provisional support points lie within a predefined ÿ-environment about a limit value, the limit value then being defined as final support point.

6. The method according to claim 1, wherein the determination of the individual characteristic curve includes:

determining at least two final support points for the individual characteristic curve by repeating the operating and ascertaining steps for different, suitably selected reference operating points; and ascertaining the individual characteristic curve for the actually used metering unit by interpolation of the at least two support points and extrapolation of inflection points of the individual characteristic curve resulting from the interpolation of a plurality of support points.

7. The method according to claim 1, wherein each reference operating point is defined by at least one of (a) a predefined pressure in the fuel accumulator, (b) a predefined injection quantity and (c) a predefined rotational speed of the internal combustion engine.

8. The method according to claim 1, wherein, to ascertain a single individual characteristic curve, the individual reference operating points are placed in different operating states of the internal combustion engine as a function of the vehicle.

9. The method according to claim 8, wherein the operating states include at least one of (a) idle operation, (b) full load and (c) maximum torque.

10. The method according to claim 1, wherein, to determine a single individual characteristic curve, the individual reference operating points are placed in those operating states of the internal combustion engine as a function of the vehicle in which the internal combustion engine is operated most often upon installation in a vehicle.

11. A computer-readable storage medium storing a set of instructions, the set of instructions capable of being executed by a processor to implement a method for operating an internal combustion engine having an injection system, comprising:

conveying fuel into a fuel accumulator by a metering unit and a high-pressure pump;

recording and regulating a pressure in the fuel accumulator by controlling the metering unit; and ascertaining an individual characteristics curve that represents an actual response of the metering unit for control of the metering unit during operation of the internal combustion engine; and determining a support point for the individual characteristic curve which represents a fuel-mass flow supplied by the metering unit for the high pressure pump as a function of a control current, including:

operating the internal combustion engine in a suitable predetermined reference operation point; and ascertaining a provisional support point of the individual characteristic curve for the reference operating point as a value pair encompassing the fuel-mass flow provided by the metering unit in the reference operating point for the high-pressure pump, and an associated electrical control current.

12. A control unit for an internal combustion engine having an injection system in which fuel is conveyed into a fuel accumulator by a metering unit and a high-pressure pump and in which pressure in the fuel accumulator is recorded and regulated by controlling the metering unit, comprising:

an arrangement adapted to:

ascertain an individual characteristic curve that represents an actual response of the metering unit during operation of the internal combustion engine; and determine a support point for the individual characteristic curve which represents a fuel-mass flow supplied by the metering unit for the high pressure pump as a function of a control current, including:

operating the internal combustion engine in a suitable predetermined reference operating point; and ascertaining a provisional support point of the individual characteristic curve for the reference operating point as a value pair encompassing the fuel-mass flow provided by the metering unit in the reference operating point for the high-pressure pump, and an associated electrical control current.

13. The control unit according to claim 12, wherein the injection system is arranged as an injection system for a motor vehicle.

14. The control unit according to claim 12, wherein the control unit is adapted to determine a correction characteristic curve that represents a difference between a response of an actually used metering device and a response of a standardized metering device during operation of the internal combustion engine.

15. The control unit according to claim 12, wherein the control unit is adapted to control the metering unit taking the ascertained individual characteristic curve into account.

16. The control unit according to claim 15, wherein the control unit includes:

a pressure-control unit adapted to receive a system deviation as a difference between an actual pressure and a setpoint pressure in the fuel accumulator and to generate a control signal as dictated by the system deviation on the basis of a standard characteristic curve for the metering unit, the control signal representing a fuel delivery quantity to be supplied by the metering unit for the high-pressure pump in view of the system deviation;

a stored correction characteristic curve adapted to determine a correction component for the control signal, which represents a possibly different control and supply response of an actually used metering unit compared to a control and supply response of a standardized metering unit;

at least one of (a) an addition and (b) a subtraction device adapted to generate a corrected control signal for the metering unit by mathematical linking of the control signal with the correction component, the corrected control signal representing a corrected quantity request with respect to the fuel delivery quantity to be provided by the metering unit.

17. The control unit according to claim 16, further comprising a filter device adapted to generate a stabilized control signal for the metering unit by filtering the corrected control signal.

18. An internal combustion engine, comprising:

an injection system in which fuel is conveyed into a fuel accumulator by a metering unit and a high-pressure pump and in which pressure in the fuel accumulator is recorded and regulated by controlling the metering unit with the aid of a control unit;

wherein the control unit is adapted to:

ascertain an individual characteristic curve that represents an actual response of the metering unit during operation of the internal combustion engine and control the metering unit by the individual characteristic curve; and determine a support point for the individual characteristic curve which represents a fuel-mass flow supplied by the metering unit for the high pressure pump as a function of a control current, including:

operating the internal combustion engine in a suitable predetermined reference operating point; and ascertaining a provisional support point of the individual characteristic curve for the reference operating point as a value pair encompassing the fuel-mass flow provided by the metering unit in the reference operating point for the high-pressure pump, and an associated electrical control current.

19. The internal combustion engine according to claim 18, wherein the internal combustion engine is arranged as an internal combustion engine for a motor vehicle.

* * * * *